US009333772B2

(12) United States Patent
Yasufuku et al.

(10) Patent No.: US 9,333,772 B2
(45) Date of Patent: May 10, 2016

(54) PRINTING APPARATUS

(71) Applicant: SEIKO EPSON CORPORATION, Tokyo (JP)

(72) Inventors: Tomohiro Yasufuku, Nagano (JP); Yoshisada Aoki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/831,219

(22) Filed: Aug. 20, 2015

(65) Prior Publication Data

US 2016/0059592 A1 Mar. 3, 2016

(30) Foreign Application Priority Data

Aug. 28, 2014 (JP) ..... 2014-173634

(51) Int. Cl.
*B41J 29/38* (2006.01)
*B41J 13/00* (2006.01)

(52) U.S. Cl.
CPC ..... *B41J 13/0009* (2013.01); *B65H 2405/32* (2013.01)

(58) Field of Classification Search
CPC ..... B65H 2405/32; B41J 13/0009
See application file for complete search history.

(56) References Cited

U.S. PATENT DOCUMENTS 7,354,148 B2 * 4/2008 Oishi ..... B41J 11/0025 347/104
7,540,677 B2 * 6/2009 Allwright ..... B41J 13/103 271/162
7,543,808 B2 * 6/2009 Silverbrook ..... B41J 2/04541 271/9.11
7,628,555 B2 * 12/2009 Naota ..... H04N 1/00326 400/62
7,831,191 B2 * 11/2010 Mandel ..... B41J 3/62 271/9.01
2006/0163796 A1 * 7/2006 Shiohara et al. ..... 271/9.01
2006/0261535 A1 * 11/2006 Shiohara et al. ..... 271/9.01
2008/0150217 A1 6/2008 Koga et al.
2013/0050328 A1 * 2/2013 Yanagishita ..... 347/16

FOREIGN PATENT DOCUMENTS

JP 2006-184760 A 7/2006
JP 2008-156101 A 7/2008
JP 2012-158447 A 8/2012

OTHER PUBLICATIONS

Website: Amazon.com, Dated Sep. 29, 2015, Screen Shot at http://www.amazon.com/HP-Color-LaserJet-3800-printer/dp/B000BP6MHY.*

HP Color LaserJet Service Manual Excerpts, From HP Color LaserJet 3000/3600/3800 Series Printer Service Manual, Edition 1, Nov. 2005.*

* cited by examiner

*Primary Examiner* — Stephen Meier
*Assistant Examiner* — John P Zimmermann
(74) *Attorney, Agent, or Firm* — Global IP Counselors, LLP

(57) ABSTRACT

A printing apparatus which includes at least a first tray and a second tray as a tray which accommodates a printing sheet, and can be mounted with a sheet supply unit which supplies the printing sheet by being switched to any one of the first tray and the second tray.

8 Claims, 9 Drawing Sheets

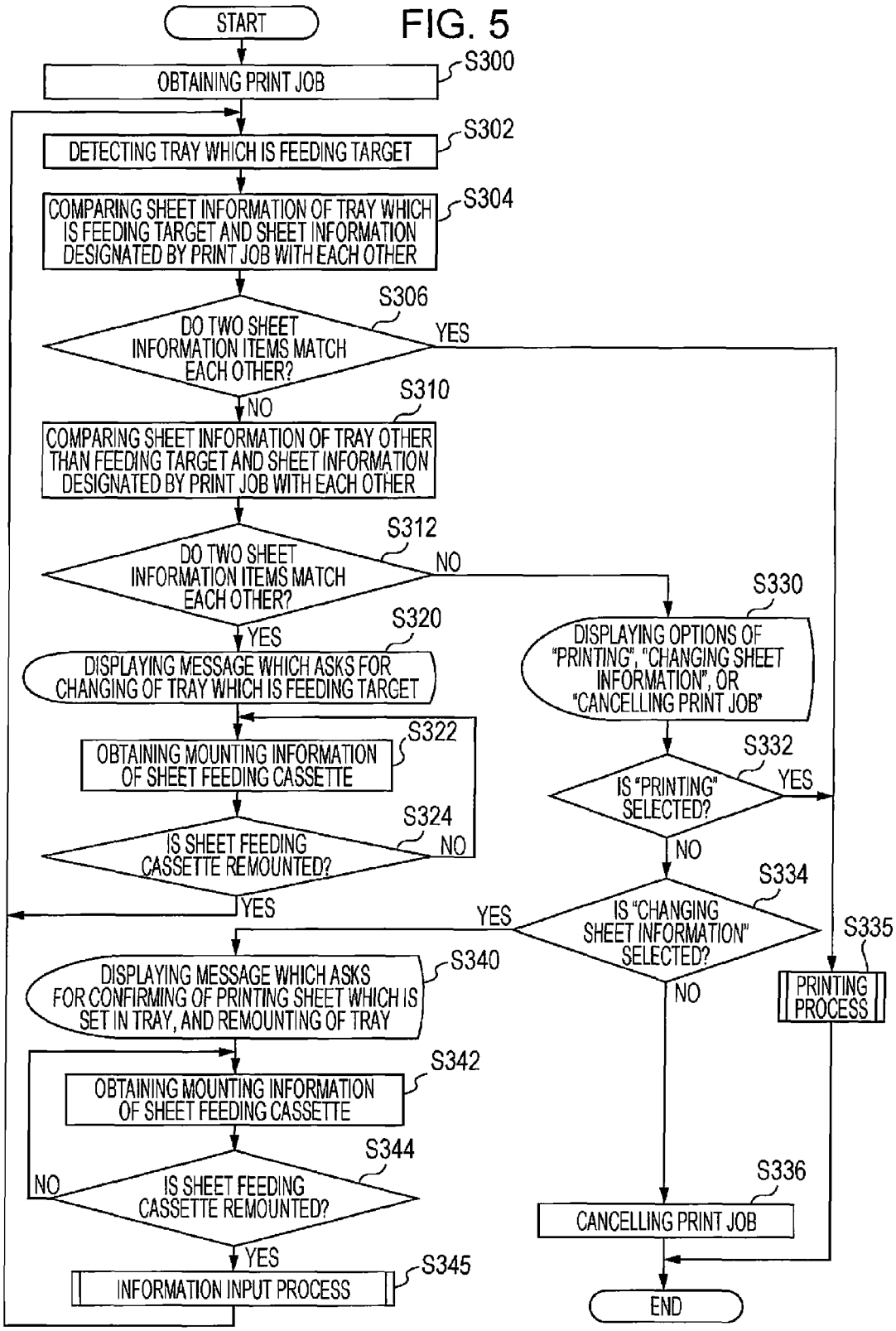
FIG. 5
START
OBTAINING PRINT JOB
S300
DETECTING TRAY WHICH IS FEEDING TARGET
S302
COMPARING SHEET INFORMATION OF TRAY WHICH IS FEEDING TARGET AND SHEET INFORMATION DESIGNATED BY PRINT JOB WITH EACH OTHER
S304
DO TWO SHEET INFORMATION ITEMS MATCH EACH OTHER?
S306
YES
NO
COMPARING SHEET INFORMATION OF TRAY OTHER THAN FEEDING TARGET AND SHEET INFORMATION DESIGNATED BY PRINT JOB WITH EACH OTHER
S310
DO TWO SHEET INFORMATION ITEMS MATCH EACH OTHER?
S312
NO
YES
DISPLAYING MESSAGE WHICH ASKS FOR CHANGING OF TRAY WHICH IS FEEDING TARGET
S320
OBTAINING MOUNTING INFORMATION OF SHEET FEEDING CASSETTE
S322
IS SHEET FEEDING CASSETTE REMOUNTED?
S324
NO
YES
DISPLAYING OPTIONS OF "PRINTING", "CHANGING SHEET INFORMATION", OR "CANCELLING PRINT JOB"
S330
IS "PRINTING" SELECTED?
S332
YES
NO
IS "CHANGING SHEET INFORMATION" SELECTED?
S334
YES
NO
PRINTING PROCESS
S335
DISPLAYING MESSAGE WHICH ASKS FOR CONFIRMING OF PRINTING SHEET WHICH IS SET IN TRAY, AND REMOUNTING OF TRAY
S340
OBTAINING MOUNTING INFORMATION OF SHEET FEEDING CASSETTE
S342
IS SHEET FEEDING CASSETTE REMOUNTED?
S344
NO
YES
INFORMATION INPUT PROCESS
S345
CANCELLING PRINT JOB
S336
END

PRINTING APPARATUS

BACKGROUND

1. Technical Field

The present invention relates to a printing apparatus.

2. Related Art

An ink jet printer which selectively ejects ink droplets onto a printing medium from nozzles, and records a desired image on the printing medium based on a print job which instructs printing has a function of being mounted with a plurality of sheet feeding cassettes in order to correspond to various types of sheets, as described in the following JP-A-2008-156101. In addition, as described in the following JP-A-2012-158447, a recording apparatus which respectively accommodates sheets in a plurality of trays which are formed in one sheet feeding cassette, and selectively extracts sheets in the tray using a common sheet feeding mechanism, in order to correspond to miniaturization of an ink jet printer is disclosed.

In addition, as described in the following JP-A-2006-184760, an image forming apparatus which displays a message for confirming whether or not a type of a sheet is changed when a sheet feeding cassette is mounted, and causes a user to input the type of the sheet when the type of the sheet is changed is disclosed.

However, when it is a state in which a first tray can feed sheets, and a print job gives an instruction of performing printing on a sheet which is accommodated in a second tray, since the user does not recognize that the first tray is a tray which can feed sheets, recognizes the fact that when an image is printed on a sheet which is accommodated in the first tray, and transition to a state in which the second tray can feed sheets is performed, it takes effort and time to perform printing on a desired sheet. In addition, when pulling out a sheet feeding cassette in order to select a tray which can feed sheets, there is a problem in that a message which causes inputting of a type of a sheet to be displayed when mounting the sheet feeding cassette, and thus, switching of sheets becomes difficult.

SUMMARY

An advantage of some aspects of the invention is to make switching of sheets at a time of printing easy.

The invention can be realized in the following forms or application examples.

APPLICATION EXAMPLE 1

According to this application example, there is provided a printing apparatus which includes at least a first tray and a second tray as a tray which accommodates a printing sheet, and can be mounted with a sheet supply unit which supplies the printing sheet by being switched to any one of the first tray and the second tray, the apparatus including: a detection unit which detects a mounting state of the sheet supply unit, and the first tray which can supply the printing sheet in the mounted sheet supply unit; a storage unit which stores information related to the printing sheet by correlating the first tray and the second tray with each other; a display unit which informs of a message by displaying the message; a reception unit which receives a print job which instructs printing; a determination unit which determines that printing is possible when information of a first printing sheet which is accommodated in the first tray, and information of a printing sheet instructed by the print job are the same, and determines that printing is possible by switching to the second tray, when information of a second printing sheet which is accommodated in the second tray, and information of the printing sheet instructed by the job are the same; a printing unit which performs printing on the printing sheet based on the print job; and a control unit which controls printing using the printing unit based on a determination result of the determination unit, in which the control unit causes the display unit to display a message which asks for switching to the second tray when the determination unit determines that printing is possible by switching to the second tray.

According to the configuration, in the sheet supply unit which supplies printing sheets by switching a plurality of trays, when information of the second printing sheets which are accommodated in the second tray which can feed printing sheets by being switched, and information of printing sheets instructed by a print job are the same, since a message which asks for switching to the second tray is displayed on the display unit, it is possible to perform switching of printing sheets to be printed quickly and easily.

APPLICATION EXAMPLE 2

According to the application example, it is preferable that the printing apparatus further includes an input unit for inputting information related to the printing sheet which is accommodated in the tray which can feed the printing sheet, when the detection unit detects mounting of the sheet supply unit, in which the storage unit stores information related to the printing sheet which is input from the input unit, in association with the tray, and when the determination unit determines that printing is possible by switching to the second tray, and mounting of the sheet supply unit is detected by the detection unit after displaying the message which asks for switching, the control unit does not request an input of information related to the printing sheet.

According to the configuration, when it is determined that printing is possible by switching to the second tray, and mounting of the sheet supply unit is detected after displaying the message which asks for the switching, it is possible to reduce a difficulty in the switching process, since there is no request for an input of information related to printing sheets.

APPLICATION EXAMPLE 3

According to the application example, it is preferable that the input unit receives any one selection of storing of information of the printing sheet instructed by a job and inputting of information of a new printing sheet, and when the determination unit determines that storing of information of the printing sheet instructed by a job is selected, the control unit causes the storage unit to store information related to the printing sheet instructed by a job, in association with the tray which can feed the printing sheet, and is detected.

According to the configuration, it is possible to select whether to store information of printing sheets instructed by a job or to input information of a new printing sheet. When the information of the printing sheets instructed by a job is stored, it is possible to cause the storage unit to store information related to the printing sheets instructed by a job in association with the tray which can feed printing sheets, and is detected by the detection unit.

APPLICATION EXAMPLE 4

According to the application example, it is preferable that, when the determination unit determines that inputting of information of the new printing sheet is selected, the control unit causes the storage unit to store information related to the new printing sheet which is input, in association with the tray which can feed the printing sheet, and is detected by the detection.

According to the configuration, when information of a new printing sheet is input, it is possible to cause the storage unit to store the information related to the new printing sheet which is input in association with the tray which can feed a printing sheet, and is detected by the detection unit.

APPLICATION EXAMPLE 5

According to the application example, it is preferable that, in a case in which printing using the print job is not ended yet, and the detection unit detects that the first printing sheet is not accommodated in the first tray, when mounting of the sheet supply unit is detected by the detection unit after the control unit causes the display unit to display a message which asks for accommodating of the first printing sheet in the first tray, the control unit does not request an input of information related to the printing sheet.

According to the configuration, when it is a case in which it is determined that printing by a print job is not ended, and the first printing sheets are not accommodated in the first tray, since there is no request for inputting of information related to printing sheets even when mounting of the sheet supply unit is detected, it is possible to reduce a difficulty which is caused when switching a tray by a user.

APPLICATION EXAMPLE 6

According to the application example, it is preferable that, when it is not possible for the detection unit to detect switching to the second tray, in a case in which the determination unit determines that printing is possible by switching to the second tray, and the detection unit detects mounting of the sheet supply unit after displaying the message which asks for switching, the control unit does not request the input of the information related to the printing sheet also in the subsequent detection of the sheet supply unit.

According to the configuration, since the input unit does not ask a user to input information when not being switched to the second tray, it is possible to reduce a difficulty.

APPLICATION EXAMPLE 7

According to the application example, it is preferable that, when the determination unit determines that printing is possible by switching to the second tray, the print job is cancelled after displaying the message which asks for switching, and mounting of the sheet supply unit is detected thereafter, the control unit requests the input of the information related to the printing sheet.

According to the configuration, since the input unit does not ask a user to input information when a print job is cancelled, it is possible to reduce a difficulty.

BRIEF DESCRIPTION OF THE DRAWINGS

The invention will be described with reference to the accompanying drawings, wherein like numbers reference like elements.

FIG. 5 is a flowchart which illustrates the flow of a process in which a control unit controls printing.

DESCRIPTION OF EXEMPLARY EMBODIMENTS

Figure 1:
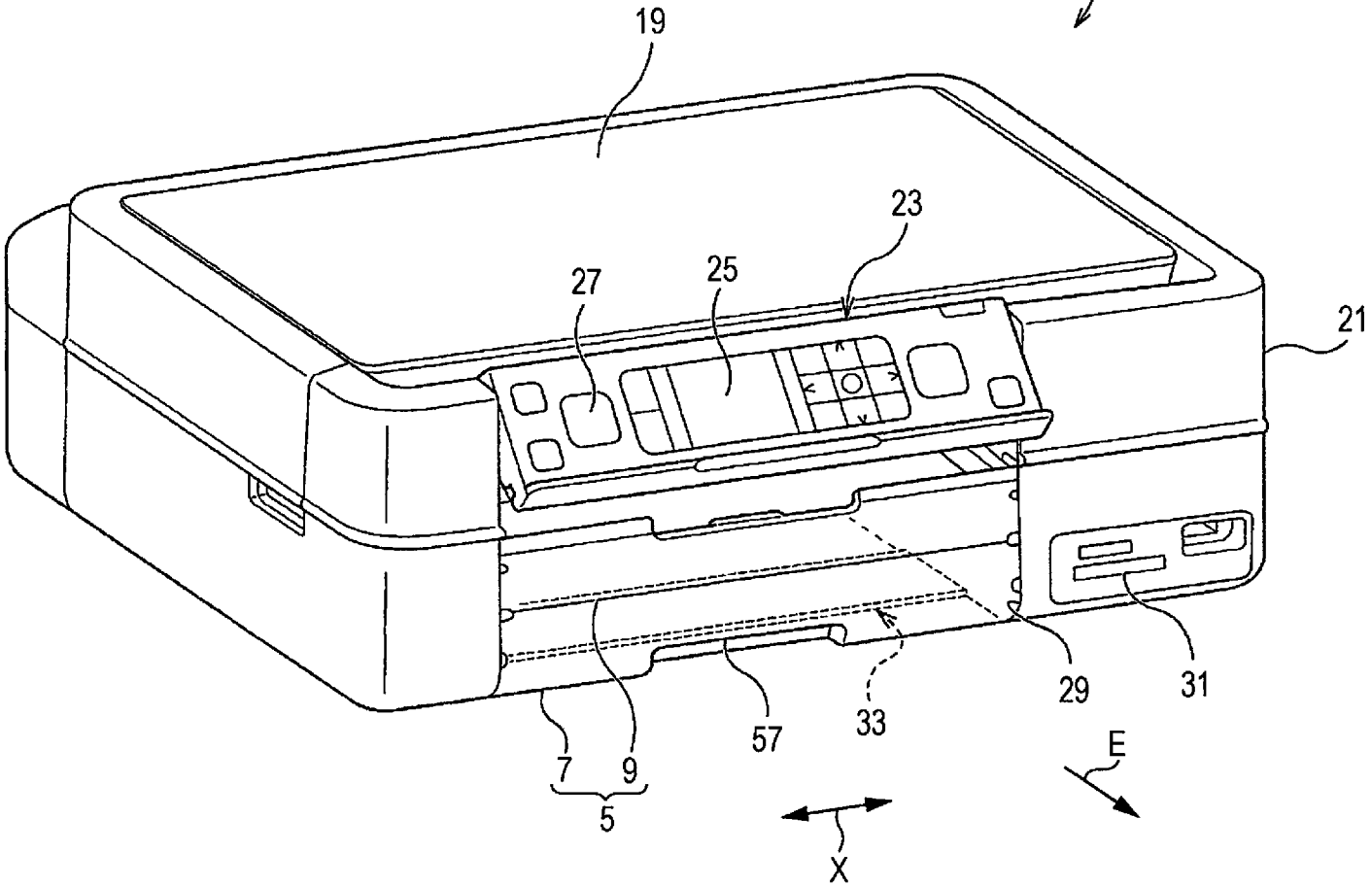
FIG. 1 is an external perspective view which illustrates a printing apparatus according to a first embodiment of the invention.

Hereinafter, an embodiment of the invention will be described with reference to drawings.

Embodiment

A printing apparatus 1 according to a first embodiment of the invention is basically configured by including a recording head 3 which executes recording on a printing sheet (hereinafter, also referred to as sheet) P which is one of a medium for recording, a multistage tray 5 which includes a first tray 7 and a second tray 9 which accommodate the sheet P, a feeding roller 11 which can feed a sheet P in the first tray 7, and a sheet P in the second tray 9 toward the recording head 3, a first reflecting unit 13 which is provided on a mounting face 7*a* on which the sheet P in the first tray 7 is mounted, a second reflecting unit 15 which is provided on a mounting face 9*a* on which the sheet P in the second tray 9 is mounted, and overlaps with the first reflecting unit 13 in the Z direction which is orthogonal to the mounting face 9*a* in a state of being located at a feeding position F, and an optical sensor 17 which is provided at the higher part in the Z direction which is orthogonal to the mounting face 7*a* of the first reflecting unit 13. The second tray 9 which is one constituent element of the multistage tray 5 is located at the higher part of the first tray 7, and can move between the feeding position F and a retracting position R.

Figure 2:
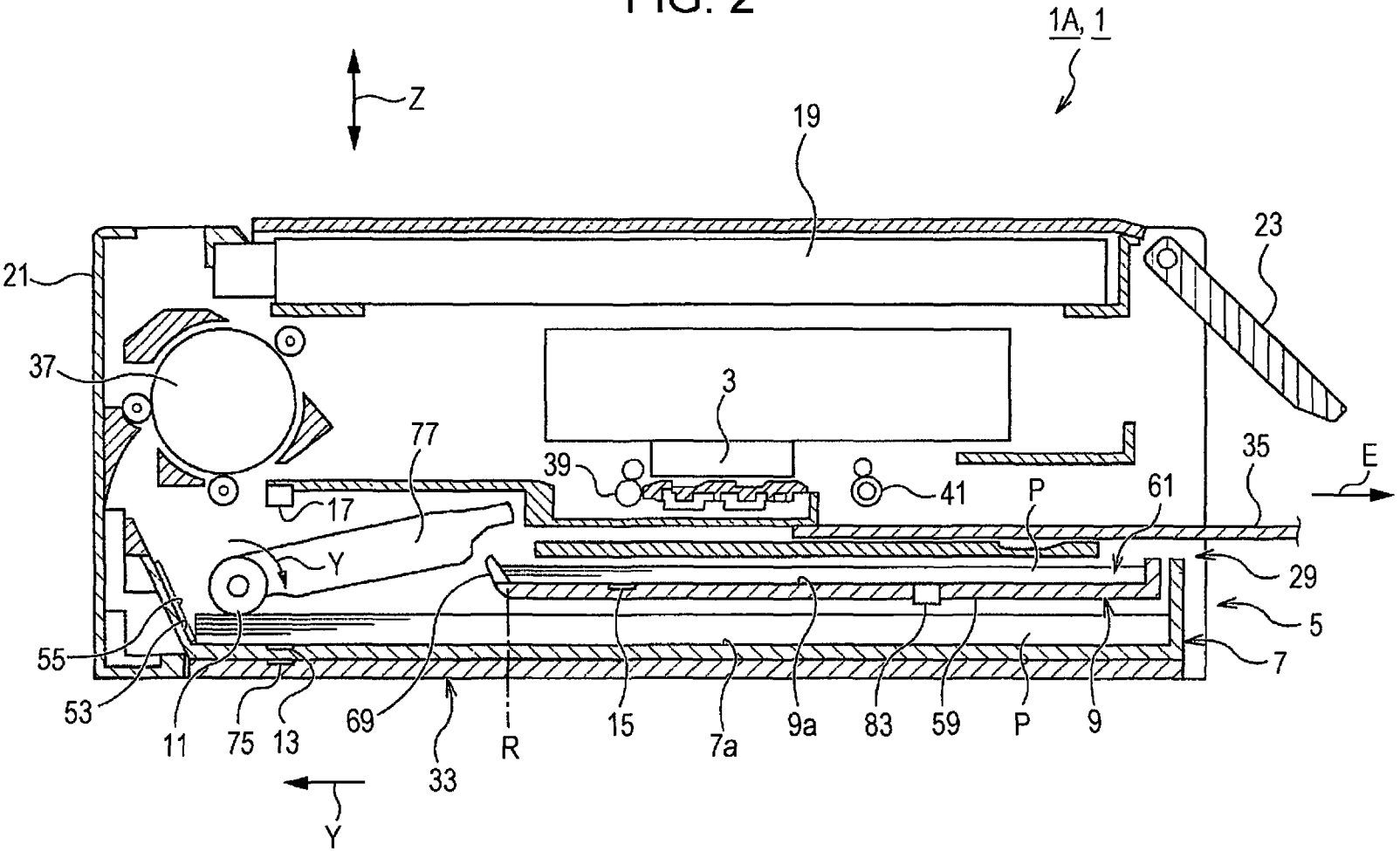
FIG. 2 is a side sectional view which illustrates the printing apparatus according to the first embodiment of the invention when sheets are fed from a first tray.
Figure 3:
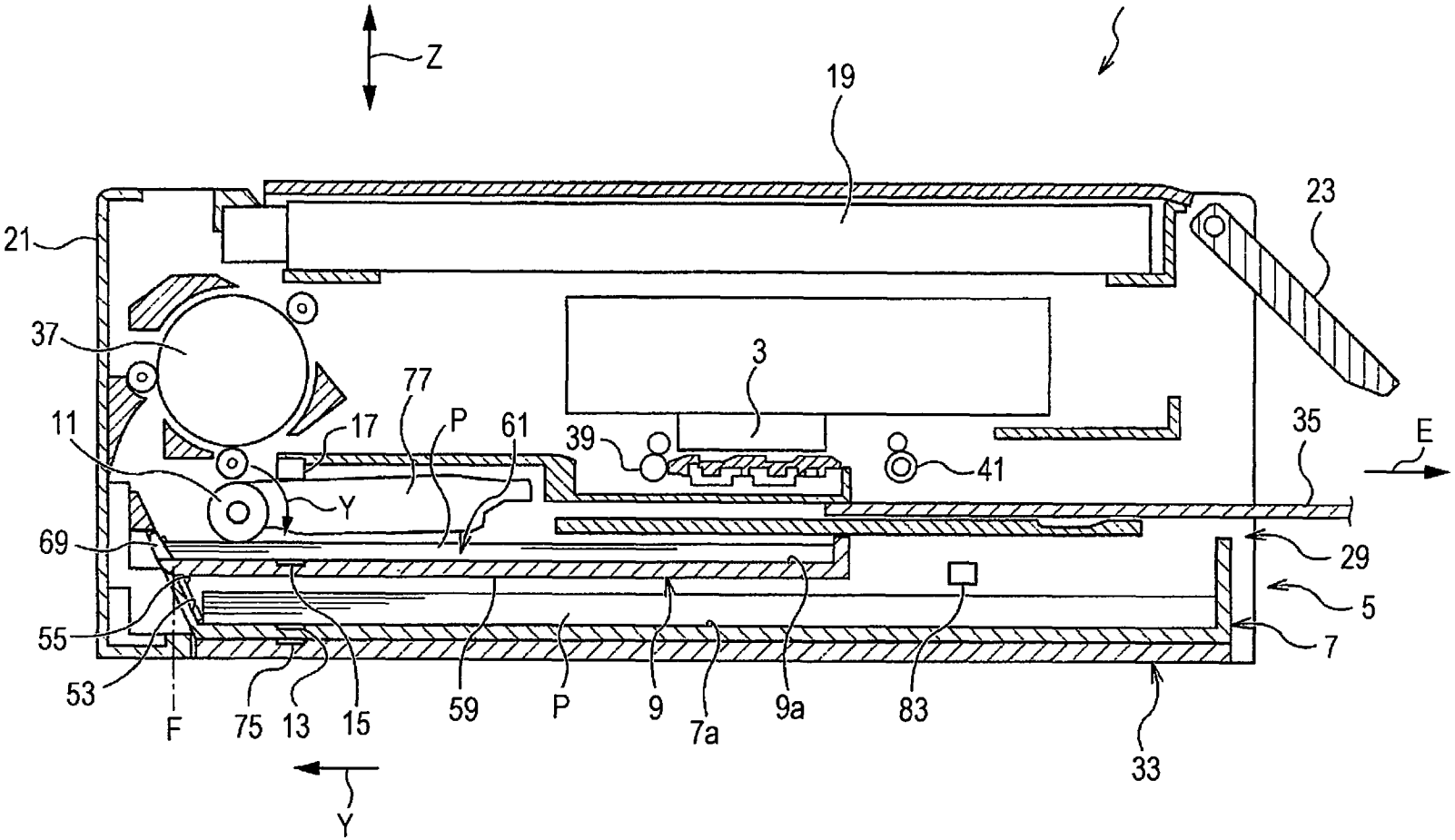
FIG. 3 is a side sectional view which illustrates the printing apparatus according to the first embodiment of the invention when sheets are fed from a second tray.

First, the entire configuration of a printing apparatus 1A according to the first embodiment will be schematically described based on FIGS. 1 to 3.

FIG. 1 is an external perspective view of the printing apparatus 1A. The printing apparatus 1A is a complex-type ink jet printer in which a scanner unit 19 is arranged at the higher part, and which ejects ink of various colors such as cyan (C), magenta (M), yellow (Y), and black (K). An operation panel 23 which is rotatable upward from the front side around a fulcrum for rotary motion which is provided at a front edge is attached to the higher part on the front face of a printing apparatus main body 21. In addition, in the operation panel 23, a display panel 25 which displays various information, contents, or the like, and an operation button 27 for inputting contents, or the like, are arranged.

The front face of a printing apparatus main body 21 at the lower part of the operation panel 23 is formed with an opening portion 29 for forming the multistage tray 5 so as to be mounted on the printing apparatus main body 21, for discharging a sheet P after being recorded to the outside, or the like. In addition, a connection unit 31 for connecting an external device is arranged on the right side of the opening portion 29.

A higher region and a lower region are present inside the printing apparatus main body 21, and various members including a support unit 33 which supports the mounted multistage tray 5, the first tray 7 which is arranged on the lower stage, the second tray 9 which is arranged on the higher stage, the feeding roller 11 for feeding the sheet P in each of the trays 7 and 9 toward the recording head 3 side, a drawer-type discharging tray 35, as an example, which receives the sheet P which is discharged to the outside of the printing apparatus main body 21 after recording, the optical sensor 17 for detecting a presence or absence of the sheet P, or a sensor 83 for detecting the tray are arranged in the lower region.

Meanwhile, in the higher region, an intermediate roller 37 for guiding the sheet P which is fed using the feeding roller 11 toward the recording head 3 by reversing the sheet, a transport roller 39 which is configured of a pair of nip rollers which transports the sheet P which is guided using the intermediate roller 37 toward a recording execution region in which the recording head 3 exists, a discharging roller 41 which is similarly configured of a pair of nip rollers for discharging the sheet P after being recorded to the outside, and the like, are arranged.

FIG. 2 is a side sectional view when the sheet P is fed from the first tray 7, and FIG. 3 is a side sectional view when the sheet P is fed from the second tray 9.

Figure 4:
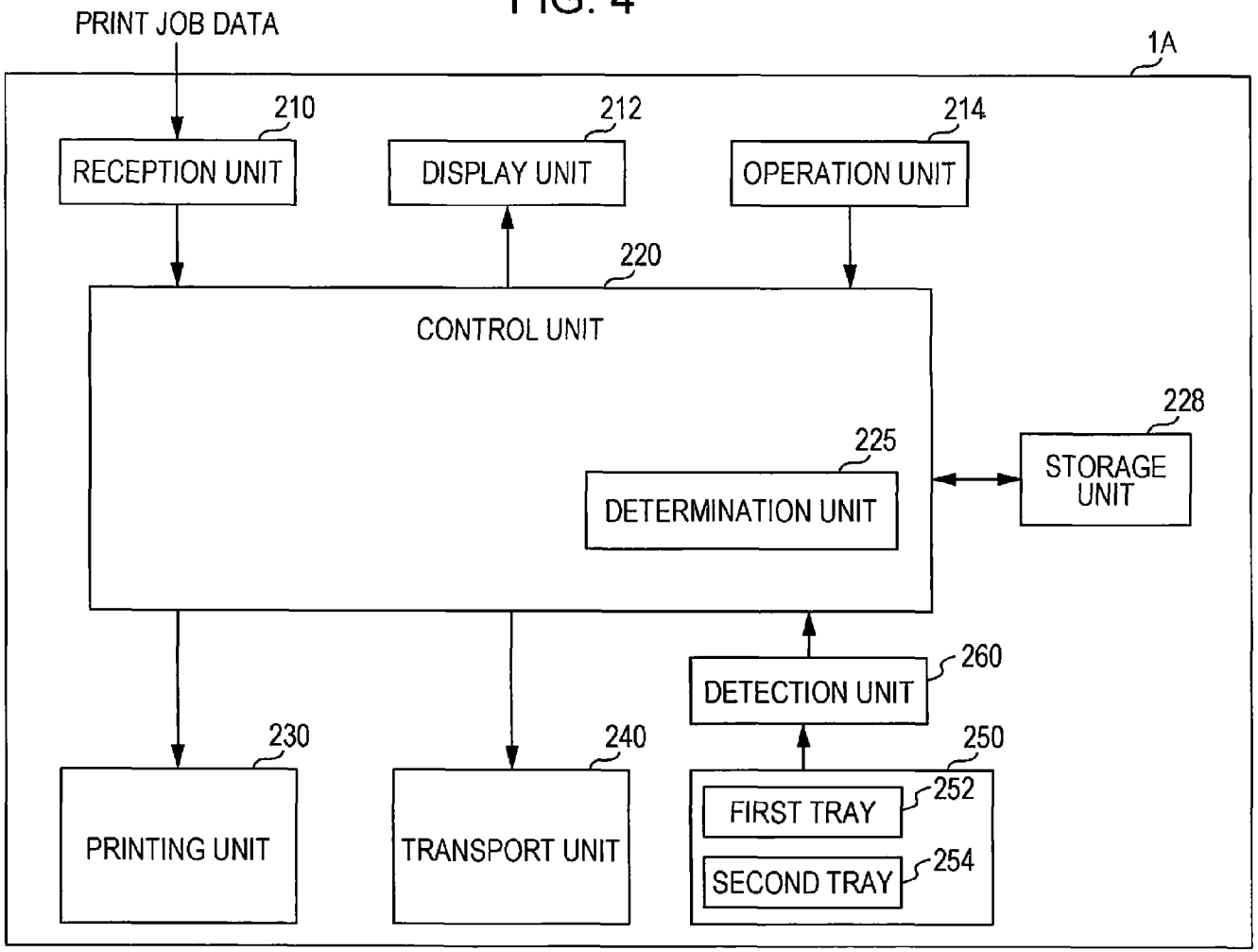
FIG. 4 is a block diagram which illustrates a functional configuration of the printing apparatus.

FIG. 4 is a block diagram which illustrates a functional configuration of the printing apparatus 1A. The printing apparatus 1A includes a reception unit 210, a display unit 212, an operation unit 214, a control unit 220, a storage unit 228, a printing unit 230, a transport unit 240, a detection unit 260, and a sheet feeding cassette 250. In addition, the control unit 220 includes a determination unit 225.

In addition, according to the embodiment, the sheet feeding cassette 250 which is the sheet supply unit is assumed to include two trays which can accommodate printing sheets; however, there is no limitation to this, and it is also possible to assume that the sheet feeding cassette includes a plurality of trays of three or more.

The reception unit 210 has a function of receiving a signal which is transmitted from an information processing device (not illustrated) which is connected through a wireless LAN such as WiFi (registered trademark), for example. In addition, the reception unit 210 analyzes the received signal, extracts print job data (hereinafter, abbreviated to print job) from the signal, and transmits the extracted print job to the control unit 220.

The display unit 212 corresponds to the display panel 25, and the operation unit 214 corresponds to the operation button 27.

In addition, the operation unit 214 corresponds to an input unit.

The control unit 220 has a function of generating print data by performing a color conversion process or an imaging process with respect to a print job which is transmitted from the reception unit 210, and transmitting the generated print data to the printing unit 230 (function of printing processing) based on the operation instruction which is input through the operation unit 214. In addition, the control unit 220 has a function of transmitting a transport instruction to the transport unit 240 based on the print data.

The transport unit 240 has a function of extracting a printing sheet from the sheet feeding cassette 250, and transporting the sheet to the printing unit 230 in the downstream direction based on the transport instruction which is transmitted from the control unit 220.

The printing unit 230 has a function of forming a print image using ink droplets on a printing sheet in cooperation with the transport unit 240 based on the print data which is transmitted from the control unit 220. According to the embodiment, when the printing unit 230 starts a printing process, a printing sheet which is mounted at a predetermined position is guided to a printing position using the transport unit 240, a carriage (not illustrated) which can reciprocate and is provided in a printing engine, reciprocates in the main scanning direction (width direction X), and ink is ejected in a guttate shape onto a sheet from the recording head 3 according to a movement position of the carriage based on image data. In addition, the sheet is intermittently guided in the feeding direction Y in response to the reciprocating movement of the carriage in the main scanning direction, and a region of the sheet to which ink is ejected is sequentially moved. In this manner, an image based on image data is formed on a sheet due to ejection of ink.

The detection unit 260 has a function of detecting a mounting state of a tray as a feeding target to which printing sheets can be supplied in a first tray 252 which denotes the first tray 7, and a second tray 254 which denotes the second tray 9 which are included in the sheet feeding cassette 250, and a function of detecting the presence or absence of sheets which are accommodated in a tray as a feeding target. According to the embodiment, the detection unit 260 corresponds to the optical sensor 17 or the tray detecting sensor 83.

In addition, the detection unit 260 informs the control unit 220 of detected information. For ease of description, according to the embodiment, a tray as a feeding target is set as the first tray 252, and a tray which is not a feeding target is set as the second tray 254, in an initial state.

The determination unit 225 compares information related to the first tray 252 and information related to a printing sheet which is designated by a print job with each other, and determines whether or not it is possible to perform printing. Here, when information of a printing sheet which is set in the first tray 252 (information of first printing sheet), and information related to a printing sheet which is designated by a print job (information of printing sheet instructed by job) are the same, the determination unit 225 determines that it is possible to perform printing, and the control unit 220 executes the above described function of printing processing <first pattern>.

On the other hand, when the determination unit 225 determines that printing is not possible, the unit further compares the information related to the second tray 254 and the information related to the printing sheet designated by the print job with each other, and determines whether or not it is possible to perform printing. Here, when information of a printing sheet which is set in the second tray 254 (information of second printing sheet), and information of the printing sheet instructed by a job are the same, the control unit 220 displays a message which asks for switching to the second tray 254.

When a user performs switching to the second tray 254, the control unit 220 executes the above described function of printing processing <Second pattern>.

In addition, when information of the second printing sheet and information of the printing sheets instructed by a job are different from each other, the control unit 220 causes the user to select executing of printing, changing of information of a sheet which is set in the tray, or cancelling of printing processing, and performs processing which is selected <third pattern>.

In addition, according to the embodiment, when the information items of the printing sheet are the same, it means that, for example, information items which denote a predetermined attribute such as a sheet size or a type of a sheet match each other.

According to the embodiment, when the sheet feeding cassette 250 is mounted in an input stand-by state of a print job, information related to a type of a tray is received; however, when a print job is input, an input of a tray as a setting target is received as a change in sheet information.

The storage unit 228 stores information such as a type or a size of a sheet by causing the information to be correlated with a tray.

The printing apparatus 1A includes a CPU, a RAM, a ROM, a storage unit, and the like, as hardware none of which are illustrated, and each function of the control unit 220 is executed when the hardware, and software which is stored in the ROM or the storage unit, cooperate with each other.

FIG. 5 is a flowchart which illustrates the flow of a process in which the control unit 220 controls printing, when the reception unit 210 receives a signal including data of a print job.

When the process is started, the control unit 220 obtains a print job from the received signal (step S300).

Subsequently, the control unit 220 detects the first tray 252 as a feeding target (step S302), and compares sheet information of a printing sheet which is set in the first tray 252, and sheet information of a printing sheet which is designated by a print job with each other (step S304).

When two sheet information items match each other, as a result of the comparison in step S304 (Yes in step S306) <first pattern>, the control unit 220 executes a printing process (step S400), and ends the process. In addition, a detail of the printing process (step S400) will be described later.

When two sheet information items do not match each other as a result of the comparison in step S304 (No in step S306), the control unit 220 compares sheet information of a printing sheet which is set in the second tray 254 which is not a feeding target and the sheet information designated by the print job with each other (step S310).

When the two sheet information items match each other as a result of the comparison in step S310 (Yes in step S312) <second pattern>, the control unit 220 displays a message which asks for a change of a tray as a feeding target, that is, switching to the second tray 254 from the first tray 252 (step S320).

Subsequently, the control unit 220 obtains mounting information which denotes a change of a mounting state of the sheet feeding cassette 250 in the printing apparatus 1A (step S322), and when the sheet feeding cassette 250 is not remounted on the printing apparatus 1A (No in step S324), the control unit returns to step S322. On the other hand, when the sheet feeding cassette 250 is remounted on the printing apparatus 1A (Yes in step S324), the control unit returns to step S302.

In addition, when the two sheet information items do not match each other as a result of the comparison in step S310 (No in step S312) <third pattern>, the control unit 220 displays options for selecting any one of executing of printing, changing of sheet information, and cancelling of the print job (step S330).

Here, when it is determined that executing of printing is selected (Yes in step S332), the control unit 220 executes a printing process (step S400), and ends the process.

In addition, when it is determined that changing of sheet information is selected (No in step S332, and Yes in step S334), the control unit 220 displays a message which asks for confirmation of the printing sheet which is set in the tray, and remounting of the tray (step S340).

Subsequently, the control unit 220 obtains mounting information which denotes a change of the mounting state of the sheet feeding cassette 250 in the printing apparatus 1A (step S342), and when the sheet feeding cassette 250 is not remounted on the printing apparatus 1A (No in step S344), the process returns to step S342. On the other hand, when the sheet feeding cassette 250 is remounted on the printing apparatus 1A (Yes in step S344), the control unit executes an information input process (step S350), and returns to step S302. Details of the information input process (step S350) will be described later.

In addition, when it is determined that cancelling of the print job is selected (No in step S332, and No in step S334), the control unit 220 cancels the print job (step S336), and ends the process.

Figure 6:
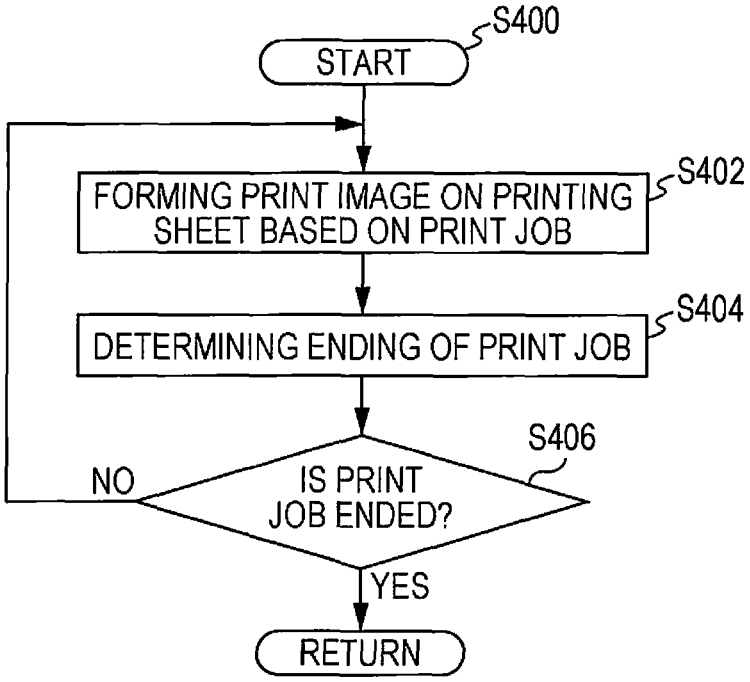
FIG. 6 is a flowchart which describes a flow of a printing process.

FIG. 6 is a flowchart which describes the flow of a printing process (step S400).

When the process is started, the control unit 220 forms a printed image on the printing sheet based on a print job (step S402).

Subsequently, the control unit 220 determines ending of the print job (step S404), and when it is determined that the print job is ended (Yes in step S406), the control unit returns to a caller of the printing process (step S400).

On the other hand, when it is determined that the print job is not ended (No in step S406), the process returns to step S402.

Figure 7:
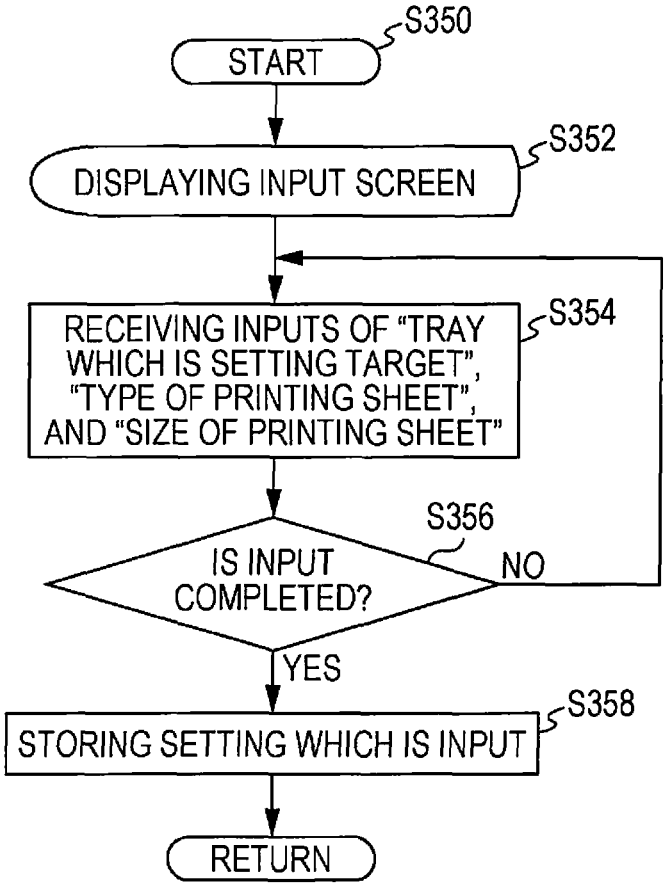
FIG. 7 is a flowchart which describes a flow of an information input process.

FIG. 7 is a flowchart which describes the flow of an information input process (step S350).

When the process is started, the control unit 220 displays an input screen (step S352), and receives inputs of information related to a tray which is a setting target, and information of a type and a size of a printing sheet (step S354).

Subsequently, the control unit 220 determines whether or not inputs are completed (step S356), and when it is determined that the inputs are not completed (No in step S356), the process returns to step S354.

On the other hand, when it is determined that the inputs are completed (Yes in step S356), the control unit 220 stores input setting in the storage unit 228 (step S358), and returns to a caller of the information input process (step S350).

According to the above described embodiment, it is possible to exhibit the following effects.

(1) The determination unit 225 compares information related to the first tray 252 as a feeding target and information related to a printing sheet which is designated by a print job with each other, and when the information of the printing sheet which is set in the first tray 252 and the information related to a printing sheet which is designated by the print job do not match each other, the determination unit 225 further compares information related to the second tray 254 which is not a feeding target and the information related to the printing sheet which is designated by the print job with each other. When the information of the printing sheet which is set in the second tray 254 and the information related to the printing sheet which is designated by the print job match each other as a result of the comparison, the control unit 220 displays a message which asks for switching to the second tray 254. Accordingly, a user is able to prepare a printing sheet which is suitable for a print job easily and rapidly when the message which asks for switching is displayed on the display unit 212 with respect to the user.

(2) In addition, when the information related to the second tray 254 and the information related to the printing sheet which is designated by the print job are compared with each other, and as a result, the information of the printing sheet which is set in the second tray 254 and the information related to the printing sheet which is designated by the print job do not match each other, since options for selecting changing of sheet information, printing, and cancelling of printing are displayed on the display unit 212, it is possible for a user to rapidly select an appropriate option.

Hitherto, a preferable embodiment has been described with reference to accompanying drawings; however, the preferable embodiment is not limited to the above described embodiment. As a matter of course, the embodiment can be variously modified without departing from the scope, and can also be executed as follows.

MODIFICATION EXAMPLE 1

Figure 8:
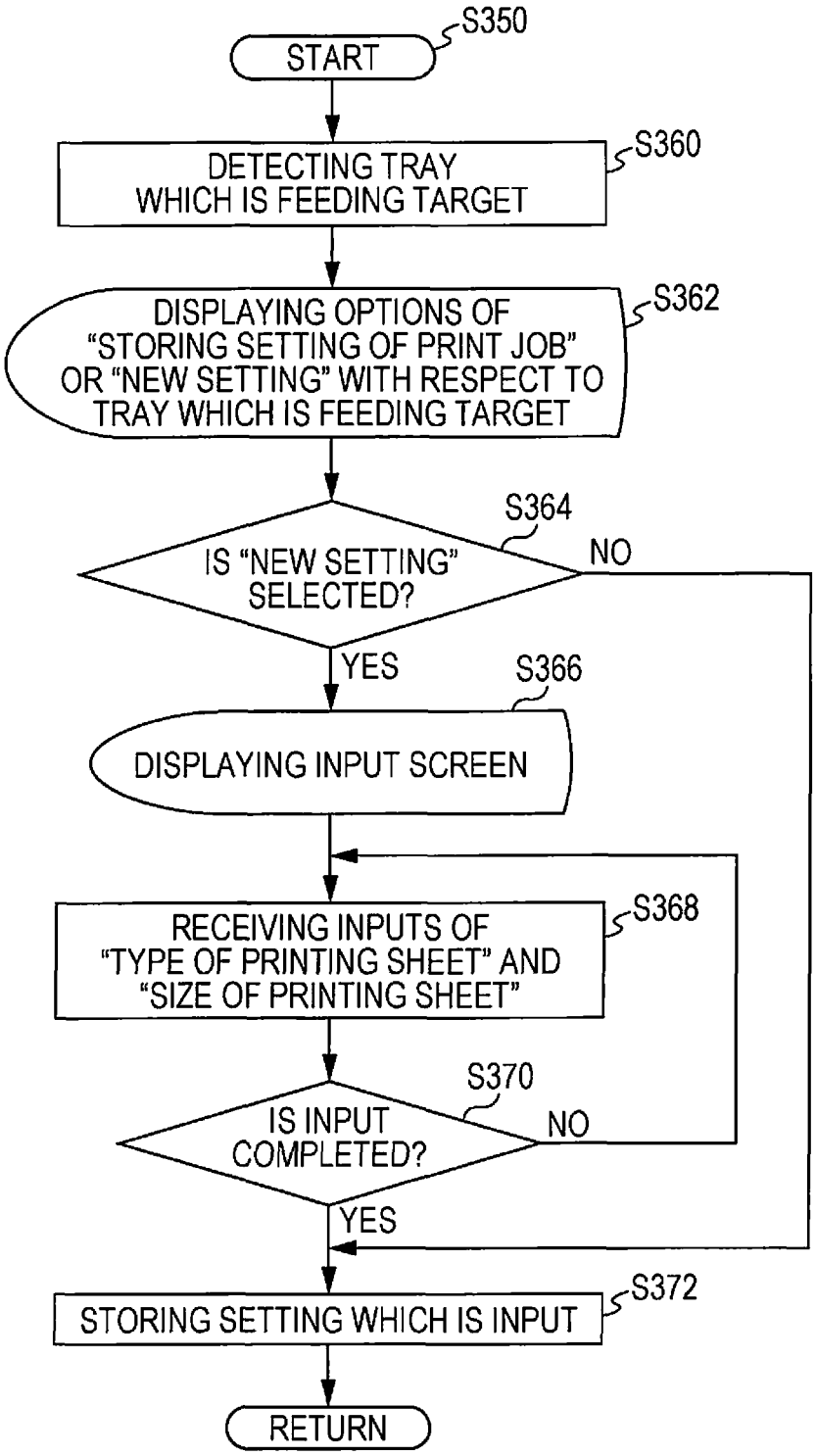
FIG. 8 is a flowchart which describes a flow of an information input process in a modification example.

In the embodiment, in the information input process (step S350), transiting to an input screen is necessarily performed, and information of a tray as a setting target of the input screen, or a type and a size of a printing sheet are received; however, there is no limitation to this. A form which is illustrated in FIG. 8 can be assumed.

That is, when the information input process (step S350) is executed, the control unit 220 detects the first tray 252 as a feeding target (step S360).

Subsequently, options for selecting whether to store setting of a print job, or to perform new setting are displayed with respect to the first tray 252 (step S362).

Subsequently, the control unit 220 determines the selected option (step S364), and when setting of the print job is selected (No in step S364), the process proceeds to step S372.

On the other hand, when new setting is selected (No in step S364), the control unit 220 displays an input screen (step S366), and receives inputs of a type and a size of a printing sheet (step S368).

Subsequently, the control unit 220 determines whether or not the inputs are completed (step S370), and when the inputs are not completed (No in step S370), returns to step S368.

In addition, when the inputs are completed (Yes in step S370), the process proceeds to step S372.

In step S372, the control unit 220 stores the setting in the storage unit 228, and returns to a caller.

MODIFICATION EXAMPLE 2

Figure 9:
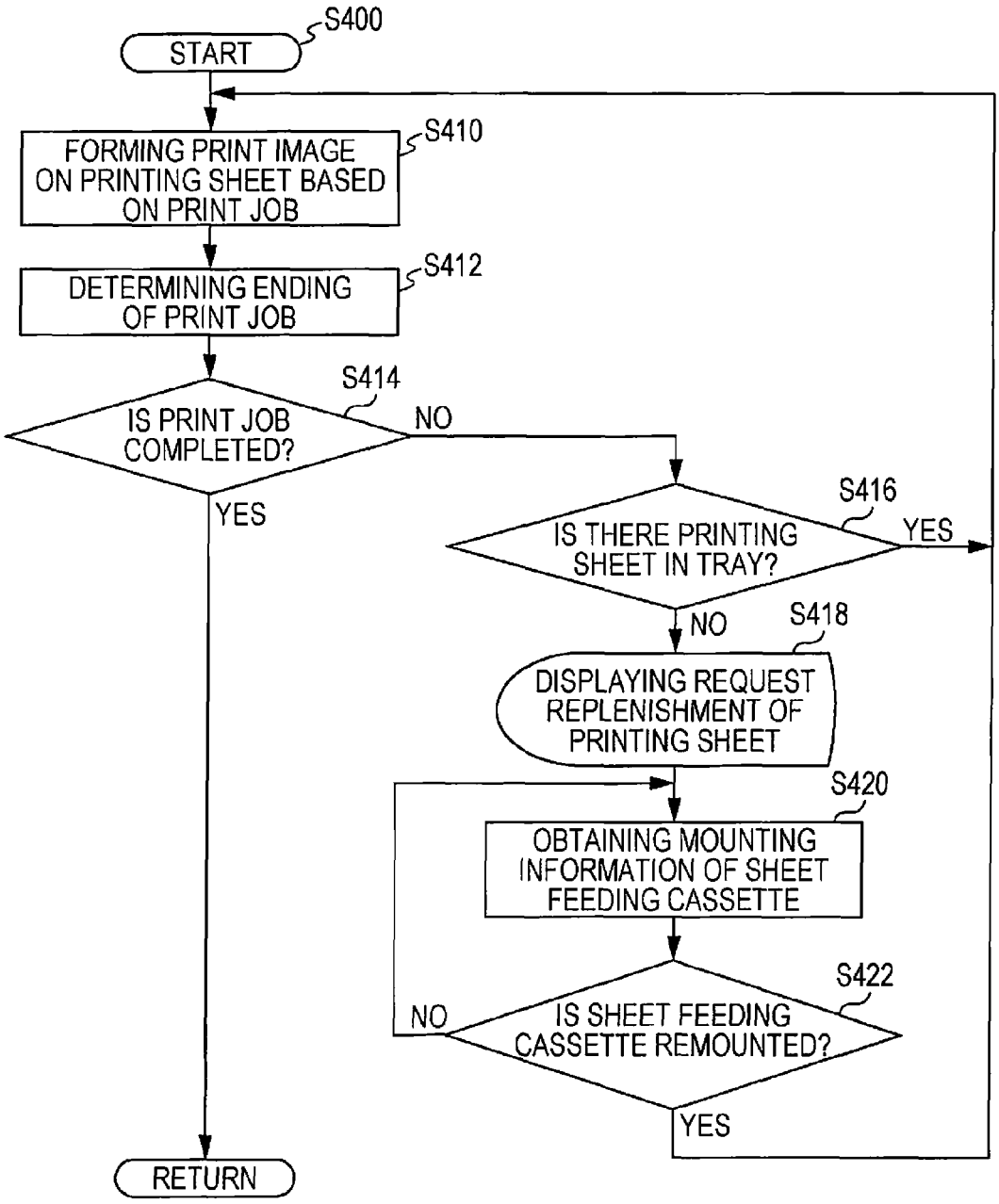
FIG. 9 is a flowchart which describes the flow of a printing process in a modification example.

As illustrated in FIG. 9, a mode responding to a case of no printing sheet in the printing process (step S400) can also be assumed.

That is, when the printing process (step S400) is started, the control unit 220 forms a printing image on a printing sheet based on a print job (step S410).

Subsequently, the control unit 220 determines ending of the print job (step S412), and when it is determined that the print job is ended (Yes in step S414), the control unit 220 returns to a caller of the printing process (step S400).

On the other hand, when it is determined that the print job is not ended (No in step S414), the control unit 220 determines whether or not there is a printing sheet in the tray (step S416).

Here, when it is determined that there is a printing sheet in the tray (Yes in step S416), the process returns to step S410.

On the other hand, when it is determined that there is no printing sheet in the tray (No in step S416), the control unit 220 displays a message which asks for replenishment of a printing sheet (step S418).

Subsequently, the control unit 220 obtains mounting information which denotes a change of the mounting state of the sheet feeding cassette 250 in the printing apparatus 1A (step S420), and when the sheet feeding cassette 250 is not remounted on the printing apparatus 1A (No in step S422), the process returns to step S420. On the other hand, when the sheet feeding cassette 250 is remounted on the printing apparatus 1A (Yes in step S422), the process returns to step S410. In this case, it is set such that an input screen related to a printing sheet which is displayed when the sheet feeding cassette 250 is mounted on the printing apparatus 1A is not displayed.

In addition, an apparatus which performs the above described method may be a single apparatus, or may be an apparatus which is configured by combining a plurality of apparatuses, and accordingly, various modes are included.

Each configuration and a combination thereof in each embodiment is an example, and it is possible to perform an addition, omission, a replacement of a configuration, and changes other than those. In addition, the invention is not limited by the embodiment, and is limited only by claims.

The entire discovery of Japanese Patent Application No.: 2014-173634, filed Aug. 28, 2014 is expressly incorporated by reference herein.

What is claimed is:

1. A printing apparatus which includes at least a first tray and a second tray as a tray which accommodates a printing sheet, and can be mounted with a sheet supply unit which supplies the printing sheet by changing a mounting state of the tray, the apparatus comprising:

a detection unit which detects the mounting state of the tray;

a storage unit which stores information related to the printing sheet by correlating the first tray and the second tray with each other;

a display unit which informs of a message by displaying the message;

a reception unit which receives a print job which instructs printing;

a determination unit which determines whether printing is possible;

a printing unit which performs printing on the printing sheet based on the print job; and a control unit which controls printing using the printing unit based on a determination result of the determination unit, wherein the determination unit determines that printing is possible when information of a printing sheet instructed by the print job is different from information of a first printing sheet in the first tray and is the same as information of a second printing sheet in the second tray under a condition that the mounting state of the tray indicates that the first tray is selected, and the control unit causes the display unit to display a message which asks for changing the mounting state of the tray to a state in which the second tray is selected.

2. The printing apparatus according to claim 1, further comprising:

an input unit configured and arranged to input information related to the printing sheet which is accommodated in the tray which can feed the printing sheet, when the detection unit detects mounting of the sheet supply unit, wherein the storage unit stores information related to the printing sheet which is input from the input unit in association with the tray, and when the determination unit determines that printing is possible by switching to the second tray, and mounting of the sheet supply unit is detected by the detection unit after displaying the message which asks for switching, the control unit does not request an input of information related to the printing sheet.

3. The printing apparatus according to claim 2, wherein the input unit receives any one selection of storing of information of the printing sheet instructed by a job and inputting of information of a new printing sheet, and when the determination unit determines that storing of information of the printing sheet instructed by a job is selected, the control unit causes the storage unit to store information related to the printing sheet instructed by a job in association with the tray which can feed the printing sheet, and is detected by the detection unit.

4. The printing apparatus according to claim 3, wherein, when the determination unit determines that inputting of information of the new printing sheet is selected, the control unit causes the storage unit to store information related to the new printing sheet which is input in association with the tray which can feed the printing sheet, and is detected by the detection unit.

5. The printing apparatus according to claim 4, wherein, in a case in which printing using the print job is not ended yet, and the detection unit detects that the first printing sheet is not accommodated in the first tray, when mounting of the sheet supply unit is detected by the detection unit after the control unit causes the display unit to display a message which asks for accommodating of the first printing sheet in the first tray, the control unit does not request an input of information related to the printing sheet.

6. The printing apparatus according to claim 2, wherein, when it is not possible for the detection unit to detect switching to the second tray, in a case in which the determination unit determines that printing is possible by switching to the second tray, and the detection unit detects mounting of the sheet supply unit after displaying the message which asks for switching, the control unit does not request the input of the information related to the printing sheet also in the subsequent detection of the sheet supply unit.

7. The printing apparatus according to claim 6, wherein, when the determination unit determines that printing is possible by switching to the second tray, the print job is cancelled after displaying the message which asks for switching, and mounting of the sheet supply unit is detected thereafter, the control unit requests the input of the information related to the printing sheet.

8. The printing apparatus according to claim 1, wherein the detection unit includes a sensor configured and arranged to detect which of the first tray and the second tray is possible to feed the printing sheet.

* * * * *